US007034760B2

(12) United States Patent
Nakamura

(10) Patent No.: US 7,034,760 B2
(45) Date of Patent: Apr. 25, 2006

(54) ANTENNA DEVICE AND TRANSMITTER-RECEIVER USING THE ANTENNA DEVICE

(75) Inventor: Mitsuyuki Nakamura, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/801,675

(22) Filed: Mar. 17, 2004

(65) Prior Publication Data

US 2004/0183741 A1 Sep. 23, 2004

(30) Foreign Application Priority Data

Mar. 18, 2003 (JP) ..... 2003-073478

(51) Int. Cl.
*H01Q 9/00* (2006.01)

(52) U.S. Cl. ..... 343/745; 343/744

(58) Field of Classification Search ..... 343/745, 343/746, 747, 748, 750, 702, 742, 743, 744, 343/700 MS, 844
See application file for complete search history.

(56) References Cited

U.S. PATENT DOCUMENTS 6,104,354 A * 8/2000 Hill et al. ..... 343/744
6,369,603 B1 4/2002 Johnston et al.
6,844,854 B1 * 1/2005 Johnson et al. ..... 343/702

FOREIGN PATENT DOCUMENTS

JP 9-284028 10/1997

* cited by examiner

*Primary Examiner*—Hoang V. Nguyen
(74) *Attorney, Agent, or Firm*—McGinn IP Law Group, PLLC

(57) ABSTRACT

An antenna device of transmission line type having two antenna elements opposed to each other, and a signal is fed between the two antenna elements. A variable-capacitance unit capable of changing the electrostatic capacity is provided at one or both of connection points at which opposite ends of the two antenna elements are connected to each other. Each variable-capacitance unit has a variable-capacitance diode, the electrostatic capacity of which changes according to a direct-current voltage applied between the anode and the cathode.

19 Claims, 5 Drawing Sheets

(a)

(b)

ANTENNA DEVICE AND TRANSMITTER-RECEIVER USING THE ANTENNA DEVICE

BACKGROUND OF THE INVENTION

1. Field of the Invention

The present invention relates to a transmitter-receiver having an antenna device and, particularly, to the antenna device of a transmission line type constituted by two lines opposed to each other.

2. Description of the Related Art

In general, an antenna device of transmission line type has a line placed above a planar conductor with a spacing provided between the line and the planar conductor, and a signal is fed between the line and the planar conductor. Ordinarily, characteristic analysis on such an antenna device is performed by using a mirror-image line emerged in such a position that the mirror-image line and the actual line are symmetrical about the planar conductor, and the two lines formed by the actual line and the mirror-image line can be regarded as transmission lines. For this reason, this antenna device is called a transmission line type. This antenna device of transmission line type is known as a transmission line T type, a transmission line M type, a transmission line F type (inverse F type) or the like.

An antenna device used in the field of amateur radio or the like and called "hentena" (see, for example, Japanese Patent Laid-Open No. H9-284028) can be regarded as an antenna having an actual line formed as the mirror-image line in the transmission line M type of device.

The above-described conventional antenna device of transmission line type is formed of transmission lines having a low radiation resistance. In the conventional antenna device of transmission line type, therefore, a feed current several to several ten times larger than that in an ordinary antenna device is required for the antenna elements to obtain the same radiation power as that of the ordinary antenna device. Furthermore, the low radiation resistance provides a large quality factor of the antenna and a narrow frequency band for impedance matching.

SUMMARY OF THE INVENTION

A first object of the present invention is to realize an antenna device of transmission line type having a broad matching frequency band and capable of being easily adjusted for matching.

A second object of the present invention is to provide a transmitter-receiver using mounting along peripheral side portions of a frame to enable flexible designing under restrictions due to the frame structure.

The present invention provides an antenna device of transmission line type having two antenna elements opposed to each other, and a signal is fed between the two antenna elements, and a variable-capacitance unit capable of changing the electrostatic capacity, and also the variable-capacitance unit being provided at one or both of connection points at which opposite ends of the antenna elements are connected to each other.

The length of each portion of the two antenna elements on the opposite sides of a feed point is equal to or smaller than ¼ of the wavelength of the fed signal.

The two antenna elements are spaced apart from each other by a distance smaller than the wavelength of the fed signal.

The variable-capacitance unit has a variable-capacitance diode, the electrostatic capacity of which changes according to a direct-current voltage applied between the anode and the cathode.

A predetermined direct-current voltage is applied to the variable-capacitance diode from a voltage control unit through an inductance element.

The present invention also provides a transmitter-receiver in which the above-described antenna device is mounted along peripheral side portions of a frame.

In the antenna device and the transmitter-receiver arranged as described above, the electrostatic capacity of the variable-capacitance unit inserted at one or both of the connection points at which the opposite ends of the two antenna elements are connected to each other is adjusted to achieve matching to the desired impedance at the feed point and, hence, matching to a signal of the desired frequency.

Also, the antenna device of the present invention is mounted along peripheral side portions of a frame to ensure that the antenna elements have a sufficiently effective length without a restriction due to the frame size.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

Figure 1:
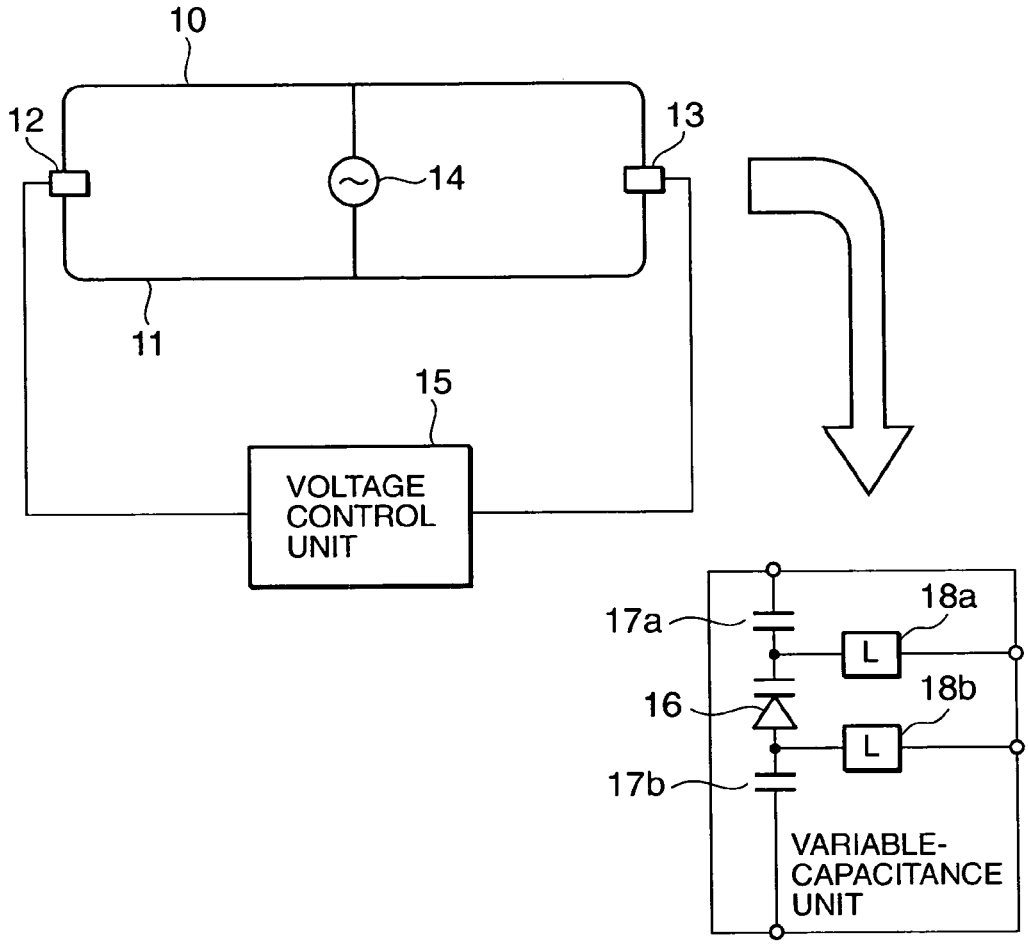
FIG. 1 is a block diagram showing the construction of an antenna device which represents a first embodiment of the present invention.

The present invention will be described with reference to the accompanying drawings. FIG. 1 is a block diagram showing the construction of an antenna device which represents a first embodiment of the present invention.

The antenna device of the present invention is an antenna device of transmission line type in which a signal is fed to two antenna elements opposed to each other. A variable-capacitance unit is inserted at one or both of two connection points at the opposite ends of two antenna elements are connected to each other. Impedance matching frequency of this antenna device can be changed by adjusting the electrostatic capacity of this variable-capacitance unit.

As shown in FIG. 1, the antenna device of this embodiment has the first antenna element 10 and the second antenna element 11 opposed to each other. A signal is fed from a signal source 14 connected between the first antenna element 10 and the second antenna element 11.

The first variable-capacitance unit 12 and the second variable-capacitance unit 13 are respectively inserted at the connection points at which the opposite ends of the first antenna element 10 and the second antenna element 11 are connected to each other.

The first antenna element 10 and the second antenna element 11 extend to opposite directions from the feed point and have a length equal to or smaller than ¼ of the wavelength of the fed signal. The first antenna element 10 and the second antenna element 11 are spaced apart from each other by a distance sufficiently small relative to the wavelength of the fed signal. Therefore, the first antenna element 10 and the second antenna element 11 function as an antenna device of transmission line type.

Each of the first variable-capacitance unit 12 and the second variable-capacitance unit 13 has a variable-capacitance diode 16. The electrostatic capacity between the terminals of the variable-capacitance diode 16 changes by a control voltage (direct-current voltage) supplied from a voltage control unit 15. As shown in FIG. 1, the cathode of the variable-capacitance diode 16 is ac-connected to the first antenna element 10 via a capacitor 17*a*, and the anode is ac-connected to the second antenna element 11 via a capacitor 17*b*. The variable-capacitance diode 16 is also connected to the voltage control unit 15 via coils 18*a* and 18*b* which block leakage of the high-frequency signal. A positive direct-current voltage is applied to the cathode of the variable-capacitance diode 16. The first variable-capacitance unit 12 and the second variable-capacitance unit 13 are not limited to the arrangement using the variable-capacitance diode 16, if the electrostatic capacity can be changed. For example, a trimmer capacitor or the like may be used for the first variable-capacitance unit 12 and the second variable-capacitance unit 13.

The principle of the operation of the antenna device of this embodiment shown in FIG. 1 will now be described with reference to FIGS. 2(*a*) and 2(*b*).

Figure 2:
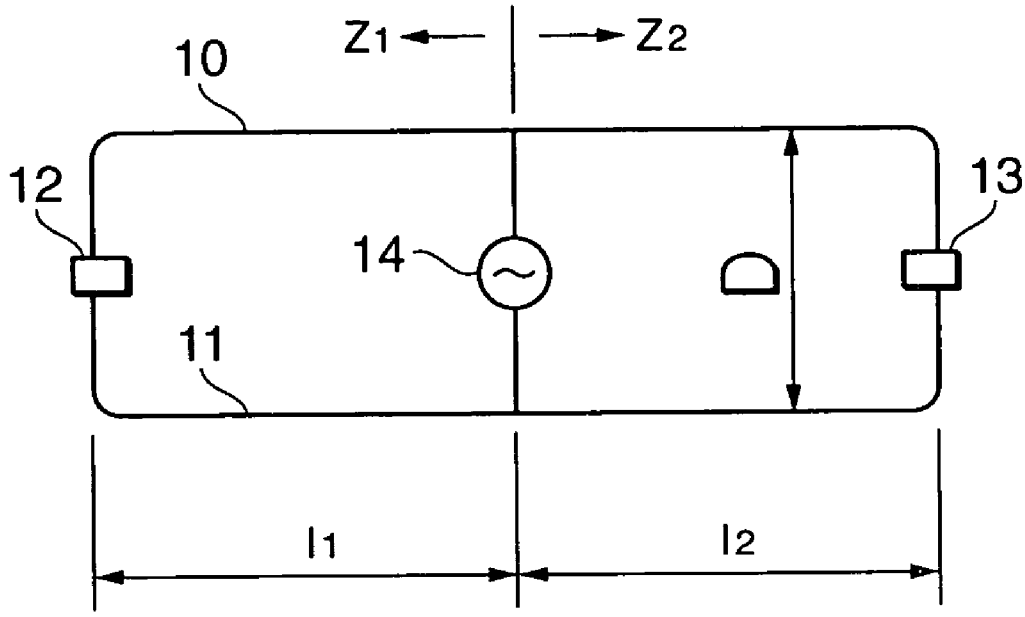
FIGS. 2(*a*) and 2(*b*) explain the principle of the operation of the antenna device shown in FIG. 1, and FIG. 2(*a*) is a plan view showing the construction of an essential portion, and FIG. 2(*b*) is an equivalent circuit diagram of the antenna device.
Figure 2:
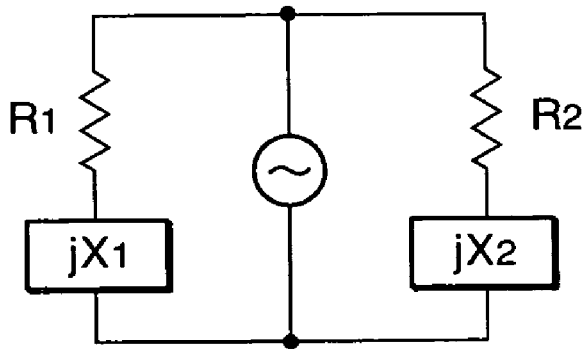

FIGS. 2(*a*) and 2(*b*) are diagrams for explaining the principle of the operation of the antenna device shown in FIG. 1. FIG. 2(*a*) is a schematic plan view showing the construction of an essential portion, and FIG. 2(*b*) is an equivalent circuit diagram of the antenna device.

For ease of description, it is assumed that the first antenna element 10 and the second antenna element 11 are two lines maintained in parallel with each other. It is also assumed that the distance D between the first antenna element 10 and the second antenna element 11 is sufficiently small relative to the wavelength of the signal fed from the signal source 14, and that the distances $l_1$ and $l_2$ from the feed point to the first variable-capacitance unit 12 and the second variable-capacitance unit 13 are equal to or smaller than about ¼ of the wavelength. Accordingly, the antenna device shown in FIG. 1 can be assumed to be a device of such a construction that two parallel lines (parallel dual lines) are connected on the right and left sides of the feed point. Radio wave radiation from the parallel dual lines is limited and the radiation resistance of the parallel dual lines is lower than that of a dipole antenna or the like.

The impedance $Z_1$ on the left-hand side as seen from the feed point on the parallel dual lines shown in FIG. 2 and the impedance $Z_2$ on the right-hand side are expressed as shown below. If the radiation resistance on the left-hand side is $R_1$; the radiation resistance on the right-hand side is $R_2$; the reactance component on the left-hand side is $X_1$; and the reactance component on the left-hand side is $X_2$, the impedance $Z_1$ and the impedance $Z_2$ are shown by the following equations:

$$Z_1=R_1+jX_1 \tag{1}$$

$$Z_2=R_2+jX_2 \tag{2}$$

Thus, the equivalent circuit shown in FIG. 2(*b*) can be substituted for the circuit shown in FIG. 2(*a*).

The capacitive reactances $x_1$ and $x_2$ of the first variable-capacitance unit 12 and the second variable-capacitance unit 13 are expressed from the electrostatic capacities $C_1$ *and* $C2$ of the first variable-capacitance unit 12 and the second variable-capacitance unit 13 and the angular frequency ω of the signal supplied from the signal source 14 by the following equations:

$$x_1=-j/\omega C_1 \tag{3}$$

$$x_2=-j/\omega C_2 \tag{4}$$

These electrostatic capacities $C_1$ and $C_2$ are converted into the reactance components $X_1$ and $X_2$ appearing at the feed point. That is, there are relationships expressed by the following equations (5) and (6):

$$X_1=-jZ_0\times\{x_1-Z_0\tan(\beta L_1)\}/\{Z_0+x_1\tan(\beta L_1)\} \tag{5}$$

$$X_2=-jZ_0\times\{x_2-Z_0\tan)(\beta L_2)\}/\{Z_0+x_2\tan(\beta L_2)\} \tag{6}$$

where $Z_0$ is the characteristic impedance of the parallel dual lines and β is a phase constant of the parallel dual lines.

The impedance Z at the feed point is equal to the impedance of the parallel connection of the right and left impedances $Z_1$ *and* $Z2$ and is expressed from the above-described equations (1) and (2) by the following equation:

$$\begin{aligned} Z &= Z_1Z_2/(Z_1+Z_2) \\ &= \{(R_1R_2-X_1X_2)(R_1+R_2)+(X_1R_2+X_2R_1)(X_1+X_2)\}/ \\ &\quad \{(R_1+R_2)^2+(X_1+X_2)^2+j\{(R_1R_2-X_1X_2)(X_1+X_2)- \\ &\quad (X_1R_2+X_2R_1)(R_1+R_2)\}/\{(R_1+R_2)^2+(X_1+X_2)^2\} \end{aligned} \tag{7}$$

Since the radiation resistance is generally proportional to the length, an approximation:

$$R_1\approx R_2=R \tag{8}$$

can be made if the lengths of the left and right antenna elements are in a relationship $l_1\approx l_2$. Equation (8) is substituted in equation (7) to obtain:

$$\begin{aligned} Z \approx R(X_1^2+X_2^2+2R^2)/\{4R^2+(X_1+X_2)^2\}- \\ j(X_1+X_2)(X_1X_2+R^2)/\{4R^2+(X_1+X_2)^2\} \end{aligned} \tag{9}$$

As can be understood from equation (9), the reactance component of the impedance Z at the feed point is zero and the impedance Z is a pure resistance if the condition $X_1+X_2=0$ is satisfied. That is, $X_1$ and $X_2$ are set to such reactances that their polarities are opposite to each other, that is, either $X_1$ or $X_2$ is an inductive reactance and the other is a capacitive reactance, and that reactances are equal in magnitude to each other. This can be realized by adjusting the electrostatic capacities $C_1$ and $C_2$, as can be understood from equations (3) to (6). If a definition:

$$X_1=-X_2=X \tag{10}$$

is made, equation (9) can be simplified into:

$$Z=(X^2+R^2)/2R \tag{11}$$

From the above explanation it can be understood that the antenna device of this embodiment can be matched to the signal having the desired frequency if the electrostatic capacity $C_1$ of the first variable-capacitance unit 12 and the electrostatic capacity $C_2$ of the second variable-capacitance unit 13 are adjusted so that the right side of equation (11) is equal to the desired impedance at the feed point while satisfying the relationship shown in equation (10).

Adjustment of the electrostatic capacity $C_1$ and the electrostatic capacity $C_2$ can be performed by changing the control voltages supplied from the voltage control unit 15 to the first variable-capacitance unit 12 and the second variable-capacitance unit 13. Even when the angular frequency $\omega$ of the signal source 14 is changed, the matching conditions can be satisfied by readjusting the control voltages.

The explanation has been provided by assuming that the radiation resistances are approximately equal, i.e., by using the condition shown in equation (8). However, even in a case where $R_1$ and $R_2$ differ from each other, a solution can be obtained from equation (7) such that the reactance component is zero and the impedance at the feed point is equal to the desired value.

The directivity of the antenna device of this embodiment in a case where each length of the first and second antenna elements is equal to or smaller than about $\lambda/2$ will be described by way of example.

Figure 3:
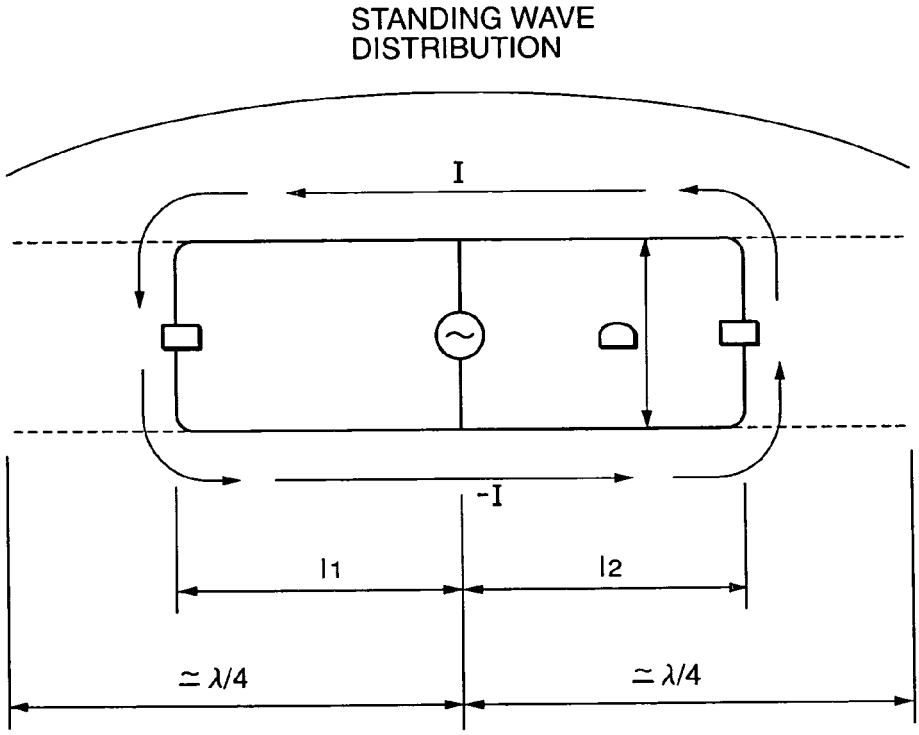
FIG. 3 is a diagram showing a standing wave distribution and the flow of current in the antenna device shown in FIG. 1.

FIG. 3 is a diagram schematically showing a standing wave distribution and the flow of current in the antenna device shown in FIG. 1.

The first antenna element 11 and the second antenna element 12 exhibit a standing wave distribution such as shown in FIG. 3 when their length is $\lambda/2$. However, when the length is shorter than $\lambda/2$, a current having an amplitude lower than the maximum amplitude of a standing wave but not zero flows through the vertical portions of the antenna elements shown in FIG. 3. The vertical portions are shorter than the horizontal portions of the antenna elements but have substantially the same radiation resistance as that of the horizontal portions since they are not parallel dual lines. Therefore, when $l_1+l_2$ is substantially shorter than $\lambda/2$, that is, a current not negligible in comparison with that in the horizontal portions flows in the vertical portions of the antenna elements, electric power radiated from the antenna device is the resultant power from both the horizontal portions of the antenna elements and the vertical portions of the antenna elements.

Figure 4:
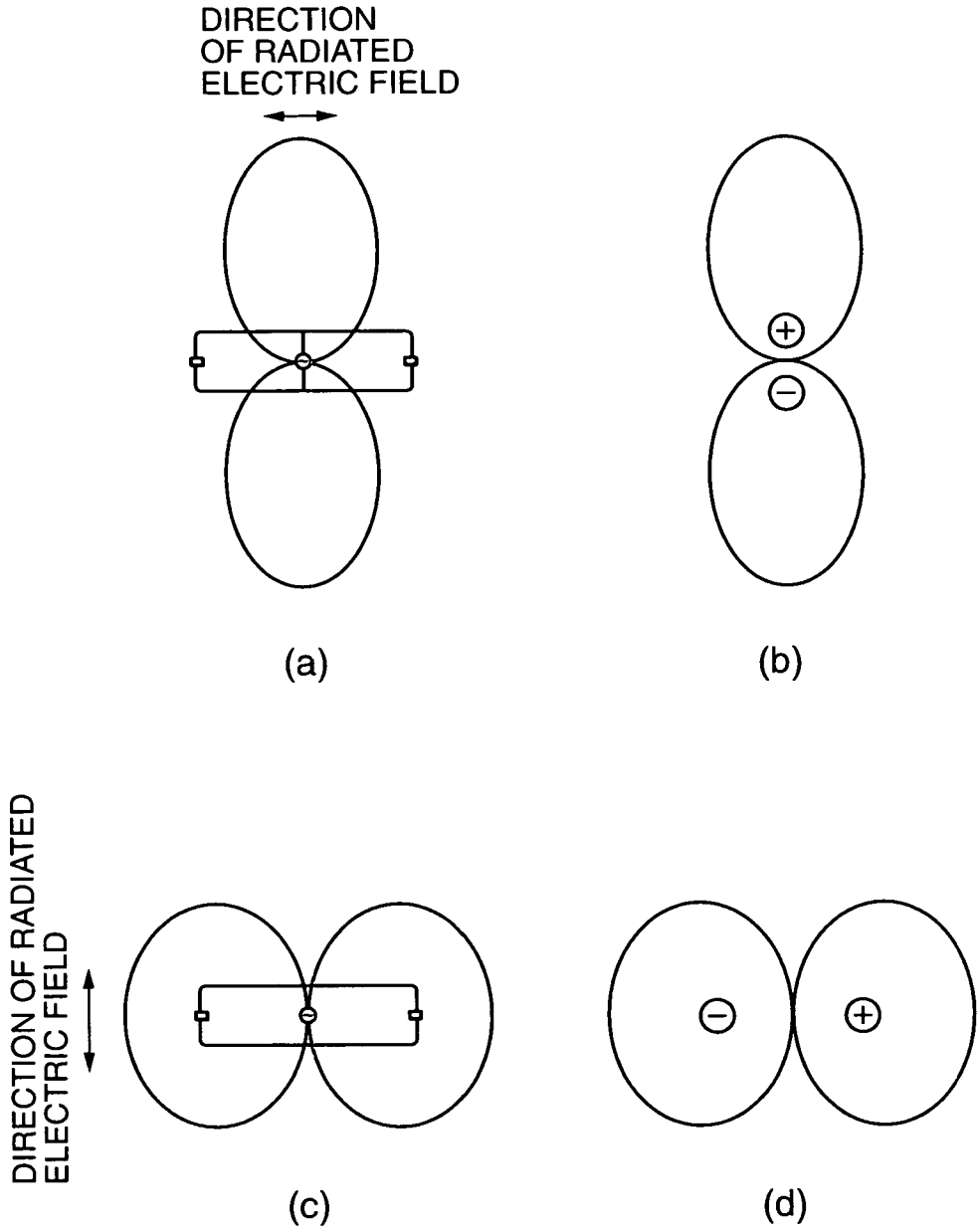
FIGS. 4(*a*) to 4(*d*) show the directivity of the antenna device shown in FIG. 1, and FIG. 4(*a*) is a plan view showing the directivity of the horizontal portions of the antenna elements, and FIG. 4(*b*) is a cross-sectional view showing the directivity as seen in a direction parallel to the lengthwise direction of the antenna device, and FIG. 4(*c*) is a plan view showing the directivity of the vertical portions of the antenna elements, and FIG. 4(*d*) is a cross-sectional view showing the directivity as seen in a direction from above the antenna device.

FIGS. 4(*a*) to 4(*d*) are diagrams showing the directivity of the antenna device shown in FIG. 1. FIG. 4(*a*) is a plan view showing the directivity of the horizontal portions of the antenna elements. FIG. 4(*b*) is a cross-sectional view showing the directivity as seen in a direction parallel to the lengthwise direction of the antenna device. FIG. 4(*c*) is a plan view showing the directivity of the vertical portions of the antenna elements. FIG. 4(*d*) is a cross-sectional view showing the directivity as seen in a direction from above the antenna device.

As shown in FIGS. 4(*a*) to 4(*d*), this antenna device exhibits a figure-8 directional pattern in all the directions, although the directivity varies in beam width and polarization direction depending on the plane in which the directivity is seen. The beam width and the gain distribution to the planes of polarization can be changed by changing $l_1$, $l_2$ and the distance D. Thus, the antenna device of this embodiment has wide directivities in various directions.

As described above, the antenna device of this embodiment is capable of broadening the matching frequency bandwidth by adjusting the electrostatic capacities of the variable-capacitance units. For example, if, in a wireless communication system using a plurality of frequency channels, control voltages optimized in relation to the frequencies are applied to the variable-capacitance diodes, even matching to one of the frequency channels deviating from the original band can be achieved.

In the antenna device of this embodiment, since a loading effect is produced by addition of the variable-capacitance units, matching can be performed even when the antenna element length is reduced from $\lambda/2$. Therefore the antenna device can be reduced in size.

Since the antenna device of this embodiment has broad directivity, it can be suitably used in a mobile wireless communication terminal in which the direction of receiving of electric waves cannot be determined in advance.

While the construction in which variable-capacitance units are provided at the both ends of the first antenna element 10 and the second antenna element 13 has been described, the same effect can also be obtained by proving a variable-capacitance unit at only one end.

An antenna device which represents a second embodiment of the present invention will be described with reference to FIGS. 5(*a*) and 5(*b*).

Figure 5:
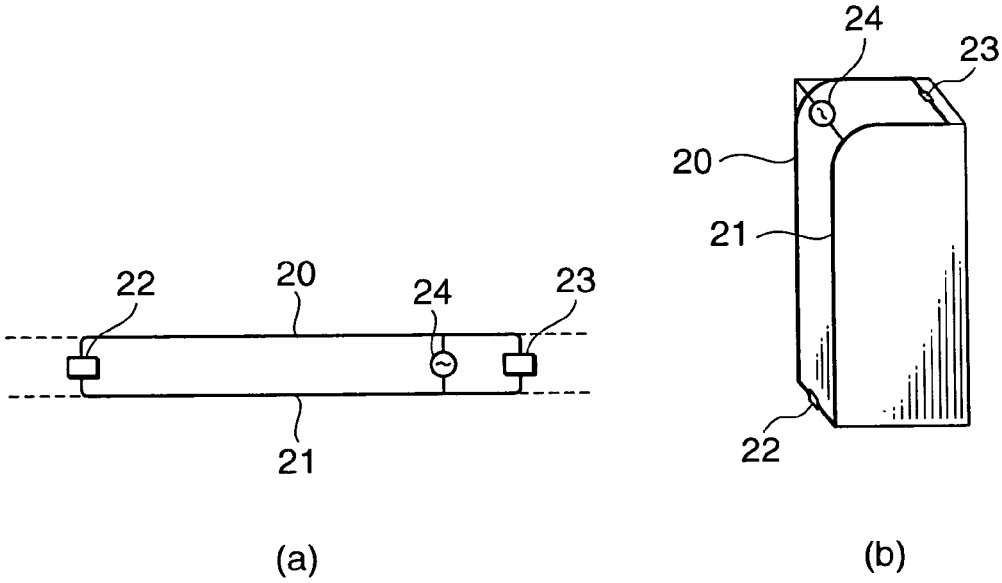
FIGS. 5(*a*) and 5(*b*) showing the construction of antenna device which represent a second embodiment of the present invention, and FIG. 5(*a*) is a plan view, and FIG. 5(*b*) is a diagram showing a mounted state.

FIGS. 5(*a*) and 5(*b*) are diagrams showing the construction of antenna device which represents a second embodiment of the present invention. FIG. 5(*a*) is a plan view and FIG. 5(*b*) is a diagram showing a mounted state.

As shown in FIG. 5(*a*), in the antenna device of the second embodiment the lengths of a first antenna element 20 and a second antenna element 21 in the left and right direction is extended and a first variable-capacitance unit 22 and a second variable-capacitance unit 23 are placed about positions defined by an integer multiple of $\lambda/2$. A signal is fed to the first antenna element 20 and the second antenna element 21 from a signal source 24 provided between these antenna elements. Also with respect to this construction, the reactances of the first variable-capacitance unit 22 and the second variable-capacitance unit 23 can be calculated by using equations (5) and (6) shown above.

In the antenna device of this embodiment, since the reactance as seen from the feed point is the same as that in the first embodiment, matching can be performed under conditions similar to those in the first embodiment, although there is a radiation resistance difference.

It is not necessary required that the dual lines of the antenna elements is parallel straight lines. Matching can be performed even in an arrangement in which the dual lines are bent. If the antenna elements are mounted along peripheral side portions of a frame as shown in FIG. 5(*b*) for example, the antenna elements can have a sufficiently long effective length without a restriction due to the frame size. Further, the dead angle of the directivity can be reduced by bending the antenna elements.

In the construction of this embodiment, the device can be flexibly designed under conditions due to the frame structure to be obtained as an antenna device of transmission line type having a broad directivity. Needless to say, the mounting method shown in FIG. 5(*b*) can be applied to the antenna device of the first embodiment shown in FIG. 1.

While this invention has been described in connection with certain preferred embodiments, it is to be understood that the subject matter encompassed by way of this invention is not to be limited to those specific embodiments. On the contrary, it is intended for the subject matter of the invention to include all alternative, modification and equivalents as can be included within the spirit and scope of the following claims.

What is claimed is:

1. An antenna device of transmission line type comprising:

two antenna elements opposed to each other, a signal being fed between said two antenna elements; and a variable-capacitance unit capable of changing the electrostatic capacity, said variable-capacitance unit being provided at one or both of connection points at which opposite ends of said two antenna elements are connected to each other.

2. The antenna device according to claim 1, wherein a length of each of portions of said two antenna elements on opposite sides of a feed point is equal to or smaller than ¼ of a wavelength of the fed signal.

3. A transmitter-receiver comprising the antenna device according to claim 2, the antenna device being mounted along peripheral side portions of a frame.

4. The antenna device according to claim 1, wherein said two antenna elements are spaced apart from each other by a distance smaller than a wavelength of the fed signal.

5. A transmitter-receiver comprising the antenna device according to claim 3, the antenna device being mounted along peripheral side portions of a frame.

6. The antenna device according to claim 1, wherein said variable-capacitance unit comprises a variable-capacitance diode, an electrostatic capacity of which changes according to a direct-current voltage applied between an anode and a cathode, and a predetermined direct-current voltage is applied to the variable-capacitance diode from a voltage control unit.

7. A transmitter-receiver comprising the antenna device according to claim 6, the antenna device being mounted along peripheral side portions of a frame.

8. A transmitter-receiver comprising the antenna device according to claim 1, the antenna device being mounted along peripheral side portions of a frame.

9. The antenna device of claim 1, wherein said two antenna elements form a pair of parallel lines and said parallel lines are bent in other than a straight line.

10. The antenna device of claim 1, wherein said variable-capacitance unit comprises a trimmer capacitor.

11. The antenna device of claim 1, wherein each said variable-capacitance unit is located along said two antenna elements at approximately an integer multiple of ½ of a wavelength of a fed signal.

12. An antenna device of transmission line type comprising two antenna elements opposed to each other, a signal being fed between said two antenna elements, wherein said two antenna elements are spaced apart from each other by a distance smaller than a wavelength of the fed signal, wherein a length of each of portions of said two antenna elements on the opposite sides of a feed point is equal to or smaller than ¼ of a wavelength of the fed signal.

13. The antenna device according to claim 12, wherein said two antenna elements comprise a variable-capacitance unit capable of changing an electrostatic capacity, said variable-capacitance unit being provided at one or both of connection points at which opposite ends of said antenna elements are connected to each other.

14. The antenna device according to claim 13, wherein said variable-capacitance unit comprises a variable-capacitance diode, an electrostatic capacity of which changes according to a direct-current voltage applied between an anode and a cathode, and a predetermined direct-current voltage is applied to the variable-capacitance diode from a voltage control unit.

15. A transmitter-receiver comprising the antenna device according to claim 14, the antenna device being mounted along peripheral side portions of a frame.

16. A transmitter-receiver comprising the antenna device according to claim 13, the antenna device being mounted along peripheral side portions of a frame.

17. A transmitter-receiver comprising the antenna device according to claim 12, the antenna device being mounted along peripheral side portions of a frame.

18. The antenna device of claim 12, wherein said two antenna elements form a pair of parallel lines and said parallel lines are bent in other than a straight line.

19. An antenna device of transmission line type comprising two antenna elements opposed to each other, a signal being fed between said two antenna elements, wherein said two antenna elements are spaced apart from each other by a distance smaller than a wavelength of the fed signal, the antenna device being mounted along peripheral side portions of a frame.

* * * * *